US009378683B2

(12) United States Patent
Chae et al.

(10) Patent No.: US 9,378,683 B2
(45) Date of Patent: Jun. 28, 2016

(54) DISPLAY DEVICE AND DRIVING METHOD THEREOF

(71) Applicant: Samsung Display Co., Ltd., Yongin, Gyeonggi-Do (KR)

(72) Inventors: Se-Byung Chae, Yongin (KR); Wook Lee, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 168 days.

(21) Appl. No.: 14/222,207

(22) Filed: Mar. 21, 2014

(65) Prior Publication Data

US 2015/0022429 A1 Jan. 22, 2015

(30) Foreign Application Priority Data

Jul. 22, 2013 (KR) ..... 10-2013-0086227

(51) Int. Cl.
*G09G 3/32* (2006.01)

(52) U.S. Cl.
CPC ..... *G09G 3/3291* (2013.01); *G09G 2310/0291* (2013.01)

(58) Field of Classification Search
CPC ..... G09G 2300/0842; G09G 2320/043; G09G 3/3233
USPC ..... 345/76–83, 92, 98–100
See application file for complete search history.

(56) References Cited

U.S. PATENT DOCUMENTS

2008/0150874 A1* 6/2008 Kida et al. ..... G09G 3/3688 345/100

FOREIGN PATENT DOCUMENTS

KR 10-1998-0068472 A 10/1998
KR 10-2003-0067582 A 8/2003

* cited by examiner

*Primary Examiner* — Kimnhung Nguyen
(74) *Attorney, Agent, or Firm* — Knobbe, Martens, Olson & Bear, LLP

(57) ABSTRACT

A display device is disclosed. In one aspect, the display device includes a display panel including a plurality of pixels, and a data driver including a plurality of data output unit buffers electrically connected to a plurality of data lines electrically connected to the pixels. Each of the data output unit buffers includes an output terminal, a first transistor for applying a high level data voltage to the output terminal, and a second transistor for applying a low level data voltage to the output terminal. Each of the data output unit buffers also includes a first switch electrically connecting the first and second transistors to the output terminal, and a second switch electrically connecting a ground voltage to the output terminal.

16 Claims, 5 Drawing Sheets

DISPLAY DEVICE AND DRIVING METHOD THEREOF

CROSS-REFERENCE TO RELATED APPLICATION

This application claims priority to and the benefit of Korean Patent Application No. 10-2013-0086227 filed in the Korean Intellectual Property Office on Jul. 22, 2013, the entire contents of which are incorporated herein by reference.

BACKGROUND

1. Field

The described technology generally relates to a display device and a driving method thereof, and more particularly, to a display device for reducing power consumption in a digital driving method.

2. Description of the Related Technology

Display devices include a display panel formed of a plurality of pixels arranged in a substantially matrix form. Display panels typically include a plurality of scan lines formed in a row direction and a plurality of data lines formed in a column direction. Each of the pixels can be driven by a scan signal and a data signal respectively received from corresponding scan and data lines.

Display devices can be classified into a passive matrix type and an active matrix type light-emitting display devices according to their driving mechanism. Based on the resolution, contrast, and response time of display devices, the general trend is towards the active matrix type where the respective pixels are selectively turned on or off.

Active matrix type light-emitting displays are generally applied with an analog driving method or a digital driving method. The analog driving method expresses a grayscale as a level of the data voltage and the digital driving method expresses the grayscale as the period that the data voltage is applied with a constant data voltage level.

In the analog driving method, a mura (e.g., irregularity or non-uniformity of image quality) can occur depending on a deviation in the characteristics (or characteristic deviation) of a driving transistor for driving an organic light-emitting diode (OLED). The characteristic deviation of the driving transistor typically results in a deviation in a threshold voltage and/or mobility between a plurality of driving transistors in a wide panel. When the same data voltage is transmitted to the gate electrodes of the driving transistors, the current flowing to the driving transistor can be modified by the characteristic deviations between the driving transistors generating an undesired mura on the panel.

The above information disclosed in this Background section is intended to facilitate the understanding of the background of the described technology and therefore it may contain information that does not constitute the prior art that is already known in this country to a person of ordinary skill in the art.

SUMMARY OF CERTAIN INVENTIVE ASPECTS

One inventive aspect is a display device for reducing power consumption in a digital driving scheme, and a driving method thereof.

Another aspect is a display device comprising: a display comprising a plurality of pixels, and a data driver comprising a plurality of data output unit buffers electrically connected to a plurality of data lines electrically connected to the pixels, wherein the data output unit buffers respectively comprise a first transistor for applying a high level data voltage to an output terminal electrically connected to a data line, a second transistor for applying a low level data voltage to the output terminal, a first switch for electrically connecting the first transistor and the second transistor to the output terminal, and a second switch for electrically connecting a ground voltage to the output terminal.

The first transistor comprises a gate electrode for receiving an image data signal, a first electrode electrically connected to the high level data voltage, and a second electrode electrically connected to the first switch, and the second transistor comprises a gate electrode for receiving the image data signal, a first electrode electrically connected to the low level data voltage, and a second electrode electrically connected to the first switch.

The second transistor is turned off when the first transistor is turned on, and the first transistor is turned off when the second transistor is turned on.

The first transistor is a p-channel field effect transistor, and the second transistor is an n-channel field effect transistor.

The low level data voltage, the ground voltage, and the high level data voltage are sequentially output to the output terminal.

The high level data voltage, the ground voltage, and the low level data voltage are sequentially output to the output terminal.

The data output unit buffers respectively comprise: a third switch for connecting a positive intermediate level voltage to the output terminal and a fourth switch for connecting a negative intermediate level voltage to the output terminal.

The low level data voltage, the ground voltage, the positive intermediate level voltage, and the high level data voltage are sequentially output to the output terminal.

The high level data voltage, the ground voltage, the negative intermediate level voltage, and the low level data voltage are sequentially output to the output terminal.

At least one of the first transistor and the second transistor is an oxide thin film transistor.

Another aspect is a method for driving a display device comprising a scan driver for sequentially applying a scan signal with a gate-on voltage to a plurality of gate lines electrically connected to a plurality of pixels and a data driver for applying a data voltage to a plurality of data lines electrically connected to the pixels, comprising: sequentially outputting at least three data voltages to the data lines substantially synchronized with the scan signal.

The outputting of the at least three data voltages to the data lines includes applying a data voltage with a first level to the data lines substantially synchronized with a first scan signal with a first gate-on voltage, applying a data voltage with a second level to the data lines substantially synchronized with a second scan signal with a second gate-on voltage, and applying a data voltage with a third level to the data lines substantially synchronized with a third scan signal with a third gate-on voltage.

The data voltage with a second level is a ground voltage, the data voltage with a first level is a high level data voltage that is greater than the ground voltage, and the data voltage with a third level is a low level data voltage that is less than the ground voltage.

The data voltage with a second level is a ground voltage, the data voltage with a first level is a low level data voltage that is less than the ground voltage, and the data voltage with a third level is a high level data voltage that is greater than the ground voltage.

The outputting of at least three data voltages to the data lines comprises: applying a data voltage with a first level to the data lines substantially synchronized with a first scan signal with a first gate-on voltage, applying a data voltage with a third level to the data lines substantially synchronized with a second scan signal with a second gate-on voltage, applying a data voltage with a fourth level to the data lines substantially synchronized with a third scan signal with a third gate-on voltage, and applying a data voltage with a fifth level to the data lines substantially synchronized with a fourth scan signal with a fourth gate-on voltage.

The data voltage with a third level is a ground voltage, the data voltage with a first level is a high level data voltage that is greater than the ground voltage, the data voltage with a fifth level is a low level data voltage that is less than the ground voltage, and the data voltage with a fourth level is a negative intermediate level voltage between the ground voltage and the low level data voltage.

The data voltage with a third level is a ground voltage, the data voltage with a first level is a low level data voltage that is less than the ground voltage, the data voltage with a fifth level is a high level data voltage that is greater than the ground voltage, and the data voltage with a fourth level is a positive intermediate level voltage between the ground voltage and the high level data voltage.

According to at least one embodiment, power consumption caused by charging and discharging of the data load in the digital driving method is reduced.

DETAILED DESCRIPTION OF CERTAIN INVENTIVE EMBODIMENTS

Figure 1:
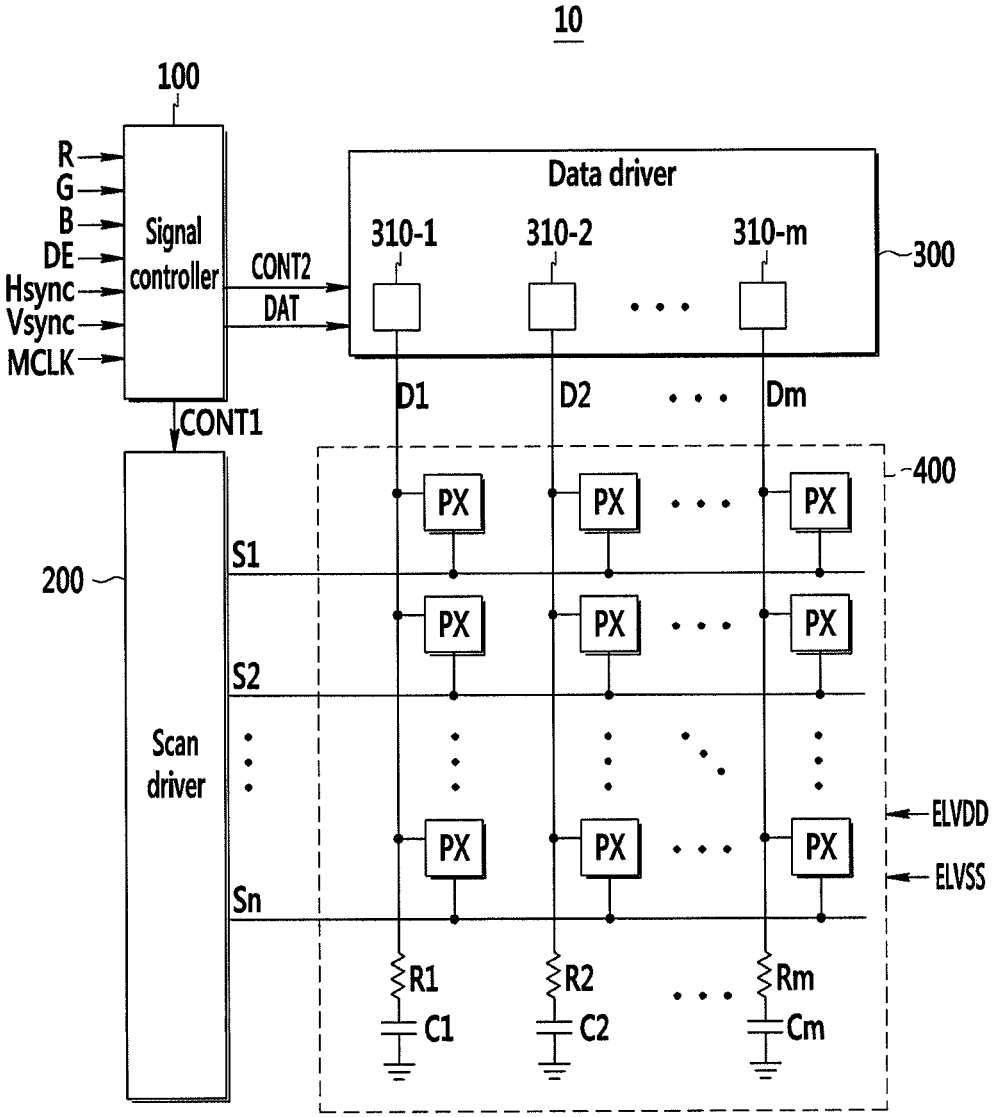
FIG. 1 shows a block diagram of a display device according to an exemplary embodiment.

In many display technologies, a digital driving method is advantageous over an analog driving method, since it is generally not significantly affected by characteristic deviations of driving thin film transistors (TFTs) in connection with using on/off states of the driving TFT. Thus, the digital driving method is more widely used for a large format panel display than the analog driving method.

Furthermore, the digital driving method can also be used to substantially prevent the generation of a mura (e.g., irregularity or non-uniformity of image quality) in displaying an image. However, this method can increase the number of times that a data signal for expressing an image frame is applied compared to the analog driving method. Thus, digital consumes more power than analog because of the charging and discharging operations of a data load which is generated by the resistance or parasitic capacitance of a data line.

In the following detailed description, only certain exemplary embodiments of the described technology have been shown and described, simply by way of illustration. As those skilled in the art would realize, the described embodiments may be modified in various different ways, all without departing from the spirit or scope of the described technology.

Further, in the following exemplary embodiments, components having the same configuration are designated by the same reference numerals, and only configurations different from those of the first exemplary embodiment are described in the other exemplary embodiments.

Elements that are unrelated to the description of the exemplary embodiments are not shown so that the description remains clear, and like reference numerals designate like element throughout the specification.

Throughout this specification and the claims that follow, when it is described that an element is "coupled" to another element, the element may be "directly coupled" to the other element or coupled to the other element through a third element. The terms "coupled" and "connected" as used herein respectively include the terms "electrically coupled" and "electrically connected." In addition, unless explicitly described to the contrary, the word "comprise" and variations such as "comprises" or "comprising" will be understood to imply the inclusion of stated elements but not the exclusion of any other elements.

FIG. 1 shows a block diagram of a display device according to an exemplary embodiment.

Referring to FIG. 1, the display device 10 includes a signal controller 100, a scan driver 200, a data driver 300, and a display (or display panel) 400.

The signal controller 100 receives video signals (R, G, B) and an input control signal for controlling the video signals (R, G, B) from an external device. The video signals (R, G, B) comprise luminance information for respective pixels (PX), and the luminance has a predetermined number of grayscales, for example, $1024=2^{10}$, $256=2^{8}$, or $64=2^{6}$ grayscales. The input control signal may comprise a vertical synchronization signal (Vsync), a horizontal synchronization signal (Hsync), a main clock signal (MCLK), and a data enable signal (DE).

The signal controller 100 uses the input video signals (R, G, B) and the input control signal to process the input video signals (R, G, B) according to operational conditions of the display 400 and the data driver 300, and generates a scan control signal (CONT1), a data control signal (CONT2), and an image data signal (DAT). The signal controller 100 transmits the scan control signal (CONT1) to the scan driver 200. The signal controller 100 transmits the data control signal (CONT2) and the image data signal (DAT) to the data driver 300

The display 400 includes a plurality of scan lines (S1-Sn), a plurality of data lines (D1-Dm), and a plurality of pixels (PX). The pixels (PX) are connected to the scan lines (S1-Sn) and the data lines (D1-Dm) and are arranged in a substantially matrix form. The scan lines (S1-Sn) extend in a row direction and are substantially in parallel to each other, and the data lines (D1-Dm) extend in a column direction and are substantially parallel to each other. The data lines (D1-Dm) have resistors (R1-Rm) and parasitic capacitors (C1-Cm), which are a data load of the data lines (D1-Dm). A first power source voltage (ELVDD) and a second power source voltage (ELVSS) for driving the pixels (PX) are supplied to the display 400

The scan driver 200 is connected to the scan lines (S1-Sn) and applies a scan signal which is a combination of a gate-on voltage and a gate-off voltage to the scan lines (S1-Sn) according to the scan control signal (CONT1). The scan driver 200 may sequentially apply the scan signal with the gate-on voltage to the scan lines (S1-Sn).

The data driver 300 is connected to the data lines (D1-Dm), and applies data voltages to the data lines (D1-Dm) substantially synchronized with the sequentially applied scan signals. The data driver 300 includes a plurality of data output unit buffers (310-1 to 310-m) which are connected to the data lines (D1-Dm).

The data output unit buffers (310-1 to 310-m) may sequentially output at least three different voltages having different voltage levels according to the image data signal (DAT) and the data control signal (CONT2). The data output unit buffers (310-1 to 310-m) output one of the at least three voltages substantially synchronized with the scan signal, and output another of the voltages substantially synchronized with the next scan signal, thereby sequentially outputting the at least three voltages.

In one embodiment, a plurality of data output unit buffers (310-1 to 310-m) sequentially output the first to third level voltages according to the image data signal (DAT) and the data control signal (CONT2). In this instance, in the digital driving method, the image data signal (DAT) is formed as a combination of 1's and 0's, that is, as a combination of high level voltages and low level voltages. One of the first to third level voltages is selected by the image data signal (DAT). One of the first to third level voltages is selectively output in accordance with the data control signal (CONT2). The first level voltage may be a high level data voltage, the third level voltage may be a low level data voltage, and the second level voltage may be a ground voltage. The high level data voltage may be a positive voltage, the low level data voltage may be a negative voltage, and the ground voltage may be an intermediate level voltage between the high level data voltage and the low level data voltage. The data output unit buffers (310-1 to 310-m) may sequentially reduce the output voltage in the order of the high level data voltage, the ground voltage, and the low level data voltage, or may sequentially increase the output voltage in the order of the low level voltage, the ground voltage, and the high level data voltage.

In another embodiment, the data output unit buffers (310-1 to 310-m) may sequentially output first to fifth level voltages according to the image data signal (DAT) and the data control signal (CONT2). One of the first level voltage and the fifth level voltage is selected by the image data signal (DAT). One of the first to fifth level voltages is selectively output in accordance with the data control signal (CONT2). The first level voltage may be a high level data voltage, the fifth level voltage may be a low level data voltage, and the third level voltage may be a ground voltage. The high level data voltage may be a positive voltage, the low level data voltage may be a negative voltage, and the ground voltage may be an intermediate level voltage between the high level data voltage and the low level data voltage. The second level voltage may be a positive voltage between the high level data voltage and the ground voltage, and the fourth level voltage may be a negative voltage between the low level data voltage and the ground voltage. The data output unit buffers (310-1 to 310-m) may sequentially reduce or increase the output voltage by using the first to fifth level voltages.

According to some embodiments, the above-described driving devices 100, 200, and 300 may be at least one integrated circuit mounted on the display 400, may be installed on a flexible printed circuit film, may be attached as a tape carrier package (TCP) to the display 400, may be mounted on an additional printed circuit board (PCB), or may be integrated with the display 400 together with the signal lines (S1-Sn, D1-Dm).

Figure 2:
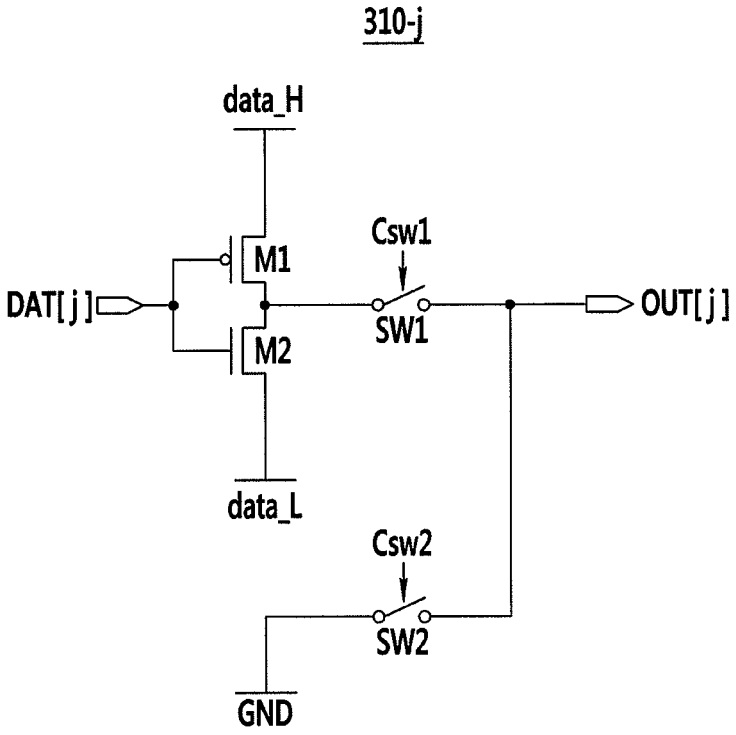
FIG. 2 shows a circuit diagram of a data output unit buffer according to an exemplary embodiment.

FIG. 2 shows a circuit diagram of a data output unit buffer according to an exemplary embodiment.

Referring to FIG. 2, a data output unit buffer (310-j) ($1 \leq j \leq m$) connected to a j-th data line will be exemplified.

The data output unit buffer (310-j) includes a first transistor (M1), a second transistor (M2), a first switch (SW1), and a second switch (SW2).

The first transistor (M1) includes a gate electrode for receiving an image data signal (DAT[j]), a first electrode connected to a high level data voltage (data_H), and a second electrode connected to a first switch (SW1). The first transistor (M1) applies the high level data voltage (data_H) to an output terminal (OUT). The first transistor (M1) may be a p-channel field effect transistor. A gate-on voltage for turning on the p-channel field effect transistor is a low level voltage, and a gate-off voltage for turning off the same is a high level voltage.

The second transistor (M2) includes a gate electrode for receiving the image data signal (DAT[j]), a first electrode connected to a low level data voltage (data_L), and a second electrode connected to the first switch (SW1). The second transistor (M2) applies the low level data voltage (data_L) to the output terminal (OUT). The second transistor (M2) may be an n-channel field effect transistor. The gate-on voltage for turning on the n-channel field effect transistor is a high level voltage and the gate-off voltage for turning off the same is a low level voltage.

Since the first transistor (M1) is a p-channel field effect transistor and the second transistor (M2) is an n-channel field effect transistor, the second transistor (M2) is turned off when the first transistor (M1) is turned on, and the first transistor (M1) is turned off when the second transistor (M2) is turned on.

Alternatively, the first transistor (M1) may be an n-channel field effect transistor and the second transistor (M2) may be a p-channel field effect transistor.

The first switch (SW1) includes a first end connected to a second electrode of the first transistor (M1) and a second electrode of the second transistor (M2), and a second end connected to the output terminal (OUT[j]). The output terminal (OUT[j]) is connected to the j-th data line (Dj). The first switch (SW1) is turned on/off by the first switch control signal (Csw1). The first switch (SW1) connects the first transistor (M1) and the second transistor (M2) to the output terminal (OUT).

The second switch (SW2) includes a first end connected to a ground voltage (GND) and a second end connected to the output terminal (OUT[j]). The second switch (SW2) is turned on/off by the second switch control signal (Csw2). The second switch (SW2) connects the ground voltage (GND) to the output terminal (OUT).

The first switch (SW1) and the second switch (SW2) may be n-channel field effect transistors or p-channel field effect transistors. The first switch control signal (Csw1) and the second switch control signal (Csw2) may be comprised in the data control signal (CONT2).

The operation of the data output unit buffer (310-j) will now be described with reference to FIG. 2 and FIG. 3.

Figure 3:
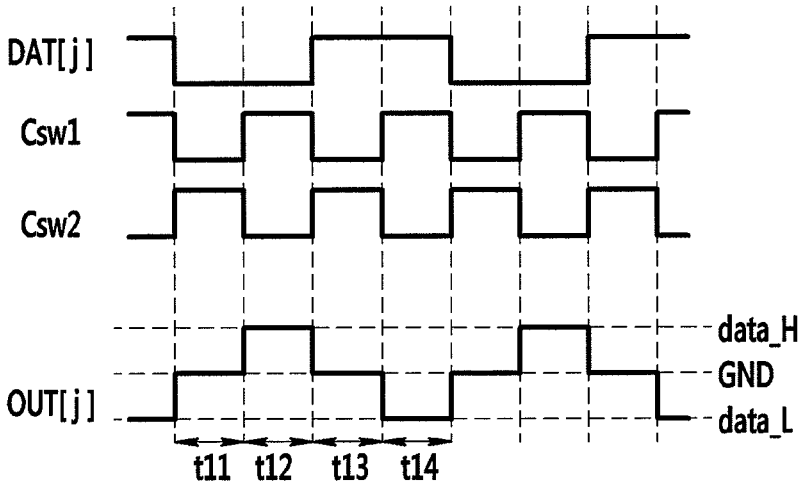
FIG. 3 shows a timing diagram of a method for driving a display device according to an exemplary embodiment.

FIG. 3 shows a timing diagram of a method for driving a display device according to an exemplary embodiment.

Referring to FIG. 2 and FIG. 3, the gate-on voltage for turning on the first switch (SW1) and the second switch (SW2) is a high level voltage and the gate-off voltage for turning them off is a low level voltage.

During a time period t11, the first switch control signal (Csw1) is applied as a gate-off voltage and the second switch control signal (Csw2) is applied as a gate-on voltage. The second switch (SW2) is turned on and the ground voltage (GND) is output to the output terminal (OUT[j]). The ground voltage (GND) may be applied to the data line (Dj) substantially synchronized with a scan signal of a first gate-on voltage.

During a time period t12, the first switch control signal (Csw1) is applied as a gate-on voltage and the second switch control signal (Csw2) is applied as a gate-off voltage. The first switch (SW1) is turned on and the second switch (SW2) is turned off. In this instance, the image data signal (DAT[j]) is applied as a low level voltage. The first transistor (M1) is turned on and the second transistor (M2) is turned off by the image data signal (DAT[j]) with a low level voltage. The high level data voltage (data_H) is output to the output terminal (OUT[j]) through the turned on first transistor (M1) and the first switch (SW1). The high level data voltage (data_H) may be applied to the data line (Dj) substantially synchronized with a scan signal of a second gate-on voltage.

During a time period t13, the first switch control signal (Csw1) is applied as a gate-off voltage and the second switch control signal (Csw2) is applied as a gate-on voltage. The second switch (SW2) is turned on and the ground voltage (GND) is output to the output terminal (OUT[j]). The ground voltage (GND) may be applied to the data line (Dj) substantially synchronized with a scan signal of a third gate-on voltage.

During a time period t14, the first switch control signal (Csw1) is applied as a gate-on voltage and the second switch control signal (Csw2) is applied as a gate-off voltage. The first switch (SW1) is turned on and the second switch (SW2) is turned off. In this instance, the image data signal (DAT[j]) is applied as a high level voltage. The first transistor (M1) is turned off and the second transistor (M2) is turned on by the image data signal (DAT[j]) with a high level voltage. The low level data voltage (data_L) is output to the output terminal (OUT[j]) through the turned on second transistor (M2) and the first switch (SW1). The low level data voltage (data_L) may be applied to the data line (Dj) substantially synchronized with a scan signal of a fourth gate-on voltage.

As described above, the data output unit buffer (310-j) may sequentially output the output voltages to the output terminal (OUT[j]) in the order of the low data level voltage (data_L), the ground voltage (GND), and the high level data voltage (data_H) in an ascending step by step manner. The data output unit buffer (310-j) may sequentially output the output voltages to the output terminal (OUT[j]) in the order of the high level data voltage (data_H), the ground voltage (GND), and the low level data voltage (data_L) in a descending step by step manner.

Accordingly, power consumption caused by charging and discharging of the data load can be reduced.

For example, it is assumed that the frame frequency (f) is about 60×10 Hz when the resolution (r) of the display 400 is 720×3×1280, the high level data voltage (data_H) is about 5 V, and the low level data voltage (data_L) is about −5 V. Further, it is assumed that the capacitance (c) of the parasitic capacitors (C1-Cm) of the data load is about 10 pF, the power efficiency (e) is about 90%, and the number of sub-frames comprised in a frame in the digital driving method is 10.

The power consumption is P=v×I/e and I=c×v. Here, v is the potential of the output voltage that is output by the data output unit buffer (310-j).

The power consumption of the data load is calculated for each of the respective time periods t11 to t14 in consideration of writing data to all pixels of the display 400 for one frame.

During the time period t11, the power consumption of the data lines (D1-Dm) caused by the data load is about 0 V [10 pF×5×720×3×1280×60×10/2]/0.9=about 0 mW.

During the time period t12, the power consumption of the data lines (D1-Dm) caused by the data load is about 5 V [10 pF×5×720×3×1280×60×10/2]/0.9=about 230 mW.

During the time period t13, the power consumption of the data lines (D1-Dm) caused by the data load is about 0 V [10 pF×5×720×3×1280×60×10/2]/0.9=about 0 mW.

During the time period t14, the power consumption of the data lines (D1-Dm) caused by the data load is about 5 V [10 pF×5×720×3×1280×60×10/2]/0.9=about 230 mW.

The summation of the power consumption caused by charging and discharging of the data load is about 460 mW.

In the case that the ground voltage (GND) is not output by the data output unit buffer (310-j) and only the high level data voltage (data_H) and the low level data voltage (data_L) are output, the summation of the power consumption by charging and discharging the data load is about 10 V [10 pF×10×720×3×1280×60×10/2]/0.9=about 922 mW.

As described above, the data output unit buffer (310-j) sequentially reduces the output voltage in the order of the high level data voltage (data H), the ground voltage (GND), and the low level data voltage (data_L), sequentially increases the output voltage in the order of the low data level voltage (data_L), the ground voltage (GND), and the high level data voltage (data_H), and outputs the data voltages so power consumption caused by charging and discharging of the data load is reduced by about half.

Figure 4:
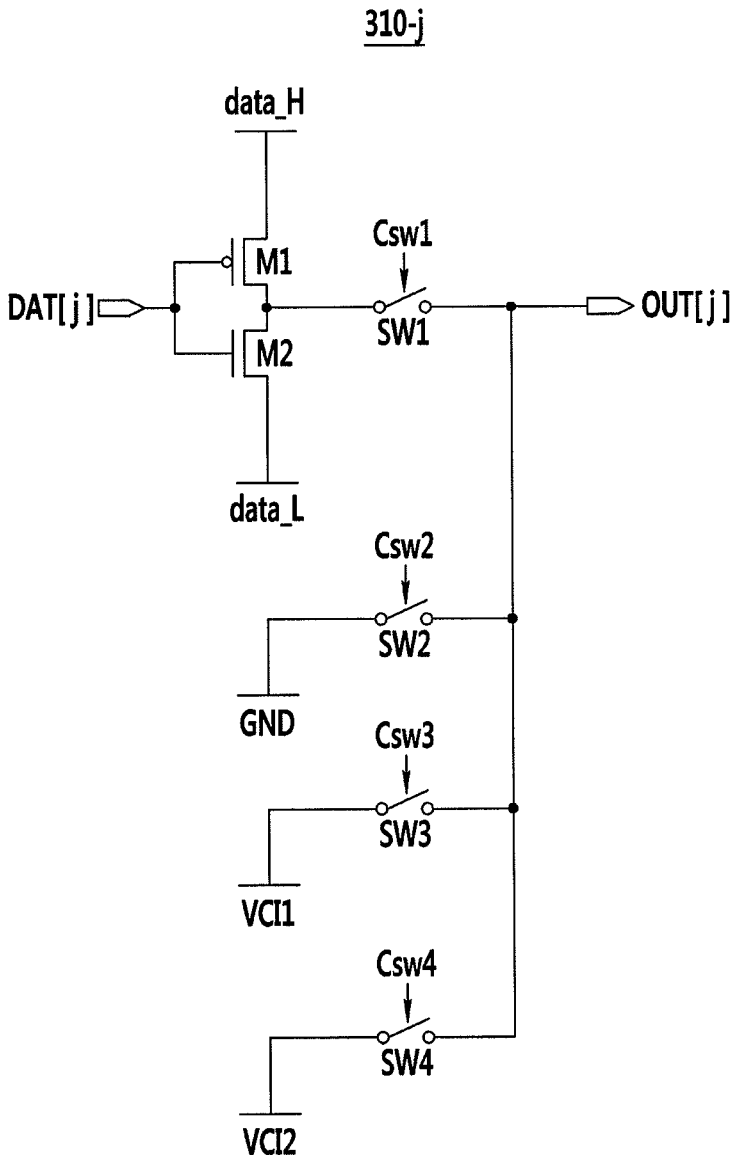
FIG. 4 shows a circuit diagram of a data output unit buffer according to another exemplary embodiment.

FIG. 4 shows a circuit diagram of a data output unit buffer according to another exemplary embodiment.

Referring to FIG. 4, the data output unit buffer 310-j (1≤j≤m) connected to the j-th data line will be exemplified.

The data output unit buffer 310-j further includes a third switch (SW3) and a fourth switch (SW4) when compared to the data output unit buffer 310-j of FIG. 2.

The third switch (SW3) includes a first end connected to a positive intermediate level voltage (VCI1) and a second end connected to the output terminal (OUT[j]). The third switch (SW3) is turned on/off by the third switch control signal (Csw3).

The fourth switch (SW4) includes a first end connected to a negative intermediate level voltage (VC12) and a second end connected to the output terminal (OUT[j]). The fourth switch (SW4) is turned on/off by the fourth switch control signal (Csw4).

The third and fourth switches (SW3 and SW4) may be n-channel field effect transistors or p-channel field effect transistors. The third and fourth switch control signals (Csw3 and Csw4) may be comprised in the data control signal (CONT2).

As described above, at least one of the first and second transistors (M1 and M2), or the first to fourth switches (SW1 to SW4) may be an oxide thin film transistor (oxide TFT) with a semiconductor layer made of an oxide semiconductor.

The oxide semiconductor may comprise one of an oxide that is made based on titanium (Ti), hafnium (Hf), zirconium (Zr), aluminum (Al), tantalum (Ta), germanium (Ge), zinc (Zn), gallium (Ga), tin (Sn), or indium (In), and complex oxides thereof such as zinc oxide (ZnO), indium-gallium-zinc oxide ($InGaZnO_4$), indium-zinc oxide (Zn—In—O), zinc-tin oxide (Zn—Sn—O) indium-gallium oxide (In—Ga—O), indium-tin oxide (In—Sn—O), indium-zirconium oxide (In—Zr—O), indium-zirconium-zinc oxide (In—Zr—Zn—O), indium-zirconium-tin oxide (In—Zr—Sn—O), indium-zirconium-gallium oxide (In—Zr—Ga—O), indium-aluminum oxide (In—Al—O), indium-zinc-aluminum oxide (In—Zn—Al—O), indium-tin-aluminum oxide (In—Sn—Al—O), indium-aluminum-gallium oxide (In—Al—Ga—O), indium tantalum oxide (In—Ta—O), indium-tantalum-zinc oxide (In—Ta—Zn—O), indium-tantalum-tin oxide (In—Ta—Sn—O), indium-tantalum-gallium oxide (In—Ta—Ga—O), indium-germanium oxide (In—Ge—O), indium-germanium-zinc oxide (In—Ge—Zn—O), indium-germanium-tin oxide (In—Ge—Sn—O), indium-germanium-gallium oxide (In—Ge—Ga—O), titanium-indium-zinc oxide (Ti—In—Zn—O), and hafnium-indium-zinc oxide (Hf—In—Zn—O).

The semiconductor layer includes a channel region in which impurities are not doped, and source and drain regions that are formed when impurities are doped on both sides of the channel region. In this instance, the impurities may be selected depending on the type of the thin film transistor used, and N-type or P-type impurities may be used.

When the semiconductor layer is made of an oxide semiconductor, an extra protection layer may be added in order to protect the oxide semiconductor since it may be vulnerable to the external environment such as being exposed to a high temperature.

The operation of the data output unit buffer (310-j) will now be described with reference to FIG. 4 and FIG. 5.

Figure 5:
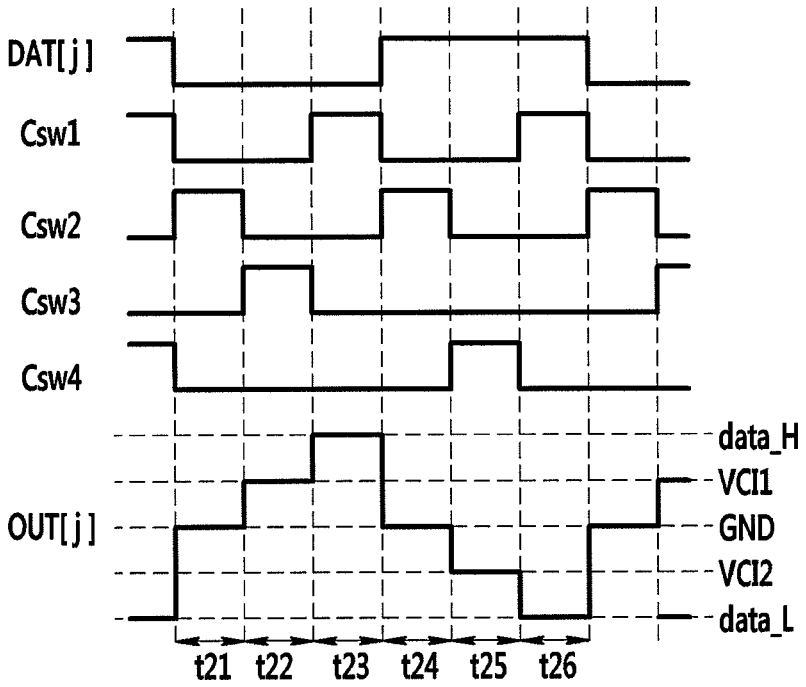
FIG. 5 shows a timing diagram of a method for driving a display device according to another exemplary embodiment.

FIG. 5 shows a timing diagram of a method for driving a display device according to another exemplary embodiment.

Referring to FIG. 4 and FIG. 5, it is assumed that the gate-on voltage for turning on the first to fourth switches (SW1 to SW4) is a high level voltage and the gate-off voltage for turning them off is a low level voltage.

During a time period t21, the second switch control signal (Csw2) is applied as a gate-on voltage. The first, third, and fourth switch control signals (Csw1, Csw3, and Csw4) are applied as a gate-off voltage. The second switch (SW2) is turned on and the ground voltage (GND) is output to the output terminal (OUT[j]). The ground voltage (GND) may be applied to the data line (Dj) substantially synchronized with a scan signal of a first gate-on voltage.

During a time period t22, the third switch control signal (Csw3) is applied as a gate-on voltage. The first, second, and fourth switch control signals (Csw1, Csw2, and Csw4) are applied as a gate-off voltage. The third switch (SW3) is turned on and a positive intermediate level voltage (VCI1) is output to the output terminal (OUT[j]). The positive intermediate level voltage (VCI1) may be applied to the data line (Dj) substantially synchronized with a scan signal of a second gate-on voltage.

During a time period t23, the first switch control signal (Csw1) is applied as a gate-on voltage. The second, third, and fourth switch control signals (Csw2, Csw3, and Csw4) are applied as a gate-off voltage. The first switch (SW1) is turned on. In this instance, the image data signal (DAT[j]) is applied as a low level voltage. The first transistor (M1) is turned on and the second transistor (M2) is turned off by the image data signal (DAT[j]) with a low level voltage. The high level data voltage (data_H) is output to the output terminal (OUT[j]) through the turned on first transistor (M1) and the first switch (SW1). The high level data voltage (data_H) may be applied to the data line (Dj) substantially synchronized with a scan signal with a third gate-on voltage.

During a time period t24, the second switch control signal (Csw2) is applied as a gate-on voltage. The first, third, and fourth switch control signals (Csw1, Csw3, and Csw4) are applied as a gate-off voltage. The second switch (SW2) is turned on and the ground voltage (GND) is output to the output terminal (OUT[j]). The ground voltage (GND) can be applied to the data line (Dj) substantially synchronized with a scan signal with a fourth gate-on voltage.

During a time period t25, the fourth switch control signal (Csw4) is applied as a gate-on voltage. The first, second, and third switch control signals (Csw1, Csw2, and Csw3) are applied as a gate-off voltage. The fourth switch (SW4) is turned on and a negative intermediate level voltage (VCI2) is output to the output terminal (OUT[j]). The negative intermediate level voltage (VCI2) may be applied to the data line (Dj) substantially synchronized with a scan signal with a fifth gate-on voltage.

During a time period t26, the first switch control signal (Csw1) is applied as a gate-on voltage. The second, third, and fourth switch control signals (Csw2, Csw3, and Csw4) are applied as a gate-off voltage. The first switch (SW1) is turned on. In this instance, the image data signal (DAT[j]) is applied as a high level voltage. The first transistor (M1) is turned off and the second transistor (M2) is turned on by the image data signal (DAT[j]) with a high level voltage. The low level data voltage (data_L) is output to the output terminal (OUT[j]) through the turned on second transistor (M2) and the first switch (SW1). The low level data voltage (data_L) may be applied to the data line (Dj) substantially synchronized with a scan signal with a sixth gate-on voltage.

As described above, the data output unit buffer (310-j) may sequentially increase the output voltages that are output to the output terminal (OUT[j]) in the order of the low data level voltage (data_L), the ground voltage (GND), the positive intermediate level voltage (VCI1), and the high level data voltage (data_H) and then output the same. The data output unit buffer (310-j) may sequentially reduce the output voltages that are output to the output terminal (OUT[j]) in the order of the high level data voltage (data_H), the ground voltage (GND), the negative intermediate level voltage (VCI2), and the low level data voltage (data_L) and then output the same.

By this method, power consumption caused by charging and discharging of the data load can be reduced.

For example, it is assumed that the frame frequency (f) is about 60×10 Hz when the resolution (r) of the display 400 is 720×3×1280, the high level data voltage (data_H) is about 5 V, the low level data voltage (data_L) is about −5 V. Further it is assumed that the positive intermediate level voltage (VCI1) is about 2.8 V, the negative intermediate level voltage (VCI2) is about −2.8 V, the capacitance (c) of the parasitic capacitors (C1-Cm) of the data load is about 10 pF, the power efficiency (e) is about 90%, and the number of sub-frames comprised in a frame in the digital driving method is 10.

The power consumption of the data load is calculated for each of the respective time periods t21 to t26 in consideration of the data writing for all pixels of the display 400 for one frame.

During a time period t21, the power consumption caused by the data load of the data lines (D1-Dm) is about 0 V×[10 pF×5×720×3×1280×60×10/2]/0.9=about 0 mW.

During a time period t22, the power consumption caused by the data load of the data lines (D1-Dm) is about 2.8 V×[10 pF×2.8×720×3×1280×60×10/2]/0.9=about 72.2 mW.

During a time period t23, the power consumption caused by the data load of the data lines (D1-Dm) is about 2.2 V ×[10 pF×2.2×720×3×1280×60×10/2]/0.9=about 44.6 mW.

During a time period t24, the power consumption caused by the data load of the data lines (D1-Dm) is about 0 V ×[10 pF×5×720×3×1280×60×10/2]/0.9=about 0 mW.

During a time period t25, the power consumption caused by the data load of the data lines (D1-Dm) is about 2.8 V×[10 pF×2.8×720×3×1280×60×10/2]/0.9=about 72.2 mW.

During a time period t26, the power consumption caused by the data load of the data lines (D1-Dm) is about 2.2 V×[10 pF×2.2×720×3×1280×60×10/2]/0.9=about 44.6 mW.

The summation of the power consumption caused by charging and discharging the data load is 233.6 mW. This sum is a quarter of the sum of 922 mW of the power consumption caused by charging and discharging of the data load when the data output unit buffer (310-j) outputs only the high level data voltage (data_H) and the low level data voltage (data_L).

As described above, the data output unit buffer (310-j) sequentially increases the output voltage and outputs the same and sequentially reduces the output voltage and outputs the same to reduce power consumption caused by charging and discharging of the data load.

The accompanying drawings and the exemplary embodiments of the described technology are only examples of the described technology, and are used to describe the described technology but do not limit the scope of the invention as defined by the following claims. Thus, it will be understood by those of ordinary skill in the art that various modifications and equivalent embodiments may be made. Therefore, the technical scope of the described technology may be defined by the following clams.

What is claimed is:

1. A display device, comprising:

a display panel comprising a plurality of pixels;

a plurality of data lines electrically connected to the pixels; and a data driver comprising a plurality of data output unit buffers electrically connected to the data lines, wherein each of the data output unit buffers comprises:

an output terminal;

a first transistor configured to output a high level data voltage;

a second transistor configured to output a low level data voltage;

a first switch configured to: i) receive the high and low level data voltages from the first and second transistors and ii) selectively output the high and low level data voltages to the output terminal; and a second switch configured to apply a ground voltage to the output terminal.

2. The display device of claim 1, wherein the first transistor comprises: i) a gate electrode configured to receive an image data signal, ii) a first electrode configured to receive the high level data voltage, and iii) a second electrode electrically connected to the first switch and wherein the second transistor comprises: i) a gate electrode configured to receive the image data signal, ii) a first electrode configured to receive the low level data voltage, and iii) a second electrode electrically connected to the first switch.

3. The display device of claim 1, wherein the second transistor is configured to be turned off when the first transistor is turned on and wherein the first transistor is configured to be turned off when the second transistor is turned on.

4. The display device of claim 1, wherein the first transistor is a p-channel field effect transistor and wherein the second transistor is an n-channel field effect transistor.

5. The display device of claim 1, wherein each of the data output unit buffers is configured to sequentially apply: i) the low level data voltage, ii) the ground voltage, and iii) the high level data voltage to the output terminal.

6. The display device of claim 1, wherein each of the data output unit buffers is configured to sequentially apply: i) the high level data voltage, ii) the ground voltage, and iii) the low level data voltage to the output terminal.

7. The display device of claim 1, wherein each of the data output unit buffers further comprises:

a third switch configured to apply a positive intermediate level voltage to the output terminal; and a fourth switch configured to apply a negative intermediate level voltage to the output terminal.

8. The display device of claim 7, wherein each of the data output unit buffers is configured to sequentially apply: i) the low level data voltage, ii) the ground voltage, iii) the positive intermediate level voltage, and iv) the high level data voltage to the output terminal.

9. The display device of claim 7, wherein each of the data output unit buffers is configured to sequentially apply: i) the high level data voltage, ii) the ground voltage, iii) the negative intermediate level voltage, and iv) the low level data voltage to the output terminal.

10. The display device of claim 1, wherein at least one of the first transistor or the second transistor is an oxide thin film transistor.

11. A method of driving a display device comprising a plurality of gate lines and a plurality of data lines, the method comprising:

applying a plurality of scan signals to the gate lines; and sequentially applying at least three data voltages to the data lines, wherein the data voltages are substantially synchronized with the scan signals, wherein the sequential applying comprises:

applying a first data voltage to the data lines, wherein the first data voltage is substantially synchronized with a first gate-on voltage of a first scan signal;

applying a second data voltage to the data lines, wherein the second data voltage is substantially synchronized with a second gate-on voltage of a second scan signal; and applying a third data voltage to the data lines, wherein the third data voltage is substantially synchronized with a third gate-on voltage of a third scan signal.

12. The method of claim 11, wherein the second data voltage is a ground voltage, wherein the first data voltage is a high level data voltage that is greater than the ground voltage, and wherein the third data voltage is a low level data voltage that is less than the ground voltage.

13. The method of claim 11, wherein the second data voltage is a ground voltage, wherein the first data voltage is a low level data voltage that is less than the ground voltage, and wherein the third data voltage is a high level data voltage that is greater than the ground voltage.

14. A method of driving a display device comprising a plurality of gate lines and a plurality of data lines, the method comprising:

applying a plurality of scan signals to the gate lines; and sequentially applying at least three data voltages to the data lines, wherein the data voltages are substantially synchronized with the scan signals, wherein the sequential applying comprises:

applying a first data voltage to the data lines, wherein the first data voltage is substantially synchronized with a first gate-on voltage of a first scan signal;

applying a third data voltage to the data lines, wherein the third data voltage is substantially synchronized with a second gate-on voltage of a second scan signal;

applying a fourth data voltage to the data lines, wherein the fourth data voltage is substantially synchronized with a third gate-on voltage of a third scan signal; and applying a fifth data voltage to the data lines, wherein the fifth data voltage is substantially synchronized with a fourth gate-on voltage of a fourth scan signal.

15. The method of claim 14, wherein the third data voltage is a ground voltage, wherein the first data voltage is a high level data voltage that is greater than the ground voltage, wherein the fifth data voltage is a low level data voltage that is less than the ground voltage, and wherein the fourth data voltage is a negative voltage between the ground voltage and the low level data voltage.

16. The method of claim 14, wherein the third data voltage is a ground voltage, wherein the first data voltage is a low level data voltage that is less than the ground voltage, wherein the fifth data voltage is a high level data voltage that is greater than the ground voltage, and wherein the fourth data voltage is a positive voltage between the ground voltage and the high level data voltage.

* * * * *